US011578579B2

(12) United States Patent
Joost et al.

(10) Patent No.: US 11,578,579 B2
(45) Date of Patent: Feb. 14, 2023

(54) WELLSITE ADAPTIVE POWER MANAGEMENT SYSTEM

(71) Applicant: STEWART & STEVENSON LLC, Houston, TX (US)

(72) Inventors: Chad Joost, Houston, TX (US); Chris Harvell, Houston, TX (US); Brian Sharp, Houston, TX (US); Paul Smith, Houston, TX (US); Ronnie Stover, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 0 days.

(21) Appl. No.: 17/064,155

(22) Filed: Oct. 6, 2020

(65) Prior Publication Data

US 2021/0285312 A1 Sep. 16, 2021

Related U.S. Application Data

(60) Provisional application No. 62/987,681, filed on Mar. 10, 2020.

(51) Int. Cl.

| | |
|---|---|
| ***E21B 43/26*** | (2006.01) |
| ***F01D 15/10*** | (2006.01) |
| ***F04B 17/03*** | (2006.01) |
| ***E21B 21/06*** | (2006.01) |

(52) U.S. Cl.

CPC ..... *E21B 43/2607* (2020.05); *F01D 15/10* (2013.01); *E21B 21/062* (2013.01); *F04B 17/03* (2013.01)

(58) Field of Classification Search

CPC .... E21B 43/2607; E21B 43/26; E21B 21/062; F01D 15/10; F04B 17/03

See application file for complete search history.

(56) References Cited

U.S. PATENT DOCUMENTS

| | | | | |
|---|---|---|---|---|
| 10,738,580 | B1 * | 8/2020 | Fischer | F04D 13/06 |
| 2019/0245348 | A1 * | 8/2019 | Hinderliter | H02J 3/381 |
| 2021/0032961 | A1 * | 2/2021 | Hinderliter | E21B 43/2607 |
| 2021/0079902 | A1 * | 3/2021 | Yeung | F04B 15/02 |

FOREIGN PATENT DOCUMENTS

| | | | | |
|---|---|---|---|---|
| WO | WO-2020219091 | A1 * | 10/2020 | E21B 43/2607 |

* cited by examiner

*Primary Examiner* — James G Sayre
(74) *Attorney, Agent, or Firm* — Ewing & Jones, PLLC

(57) ABSTRACT

A frac system includes power generation equipment and a power storage device used to provide electric power to one or more pieces of frac equipment. The frac system includes a power controller used to control the source of the power to the frac equipment. The power controller may measure the charge status for the power storage device and the electrical power load being used by the frac equipment. The power controller may engage or disengage the power generation equipment based on the measured charge status and electrical power load, may control the source of the power provided to the frac equipment, and may control whether the power storage device is being charged.

8 Claims, 11 Drawing Sheets

WELLSITE ADAPTIVE POWER MANAGEMENT SYSTEM

CROSS-REFERENCE TO RELATED APPLICATION

This application is a non-provisional application which claims priority from U.S. provisional application No. 62/987,681, filed Mar. 10, 2020, which is incorporated by reference herein in its entirety.

TECHNICAL FIELD/FIELD OF THE DISCLOSURE

The present disclosure relates generally to power systems for electrical equipment and specifically to power supplies for frac equipment.

BACKGROUND OF THE DISCLOSURE

During frac operations, multiple pieces of frac equipment may be in continuous use. Such equipment may include, for example, one or more blenders, hydrators, pumps, CAS, and belt loader systems as well as control systems for operating the equipment and infrastructure such as light plants for night operation. Typically, the frac equipment is powered using diesel engines or electric motors with one or more generators. However, the requirement to continuously supply electrical power to frac equipment, which may require continuous operation of the generators, may result in high operation costs due to fuel consumption and maintenance requirements on the generators as well as producing noise and emissions.

SUMMARY

The present disclosure provides for a method. The method may include providing a frac system. The frac system may include one or more pieces of frac equipment; power generation equipment; a power storage device; and a power controller. The method may include measuring, with the power controller, a charge status for the power storage device; measuring, with the power controller, an electrical power load being used by the frac equipment; and engaging or disengaging the power generation equipment based on the measured charge status and electrical power load.

The present disclosure also provides for a frac system. The frac system may include one or more pieces of frac equipment; a generator or gas turbine; a power storage device; and a power controller. The power controller may be adapted to selectively operate the generator or gas turbine, determine whether to power the frac equipment from the generator or gas turbine or the power storage device, and determine whether to charge the power storage device from the generator or gas turbine.

The present disclosure provides for a frac system. The frac system may include one or more pieces of frac equipment, power distribution equipment in electrical communication with the frac equipment; and power generation equipment in electrical communication with the power distribution equipment.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
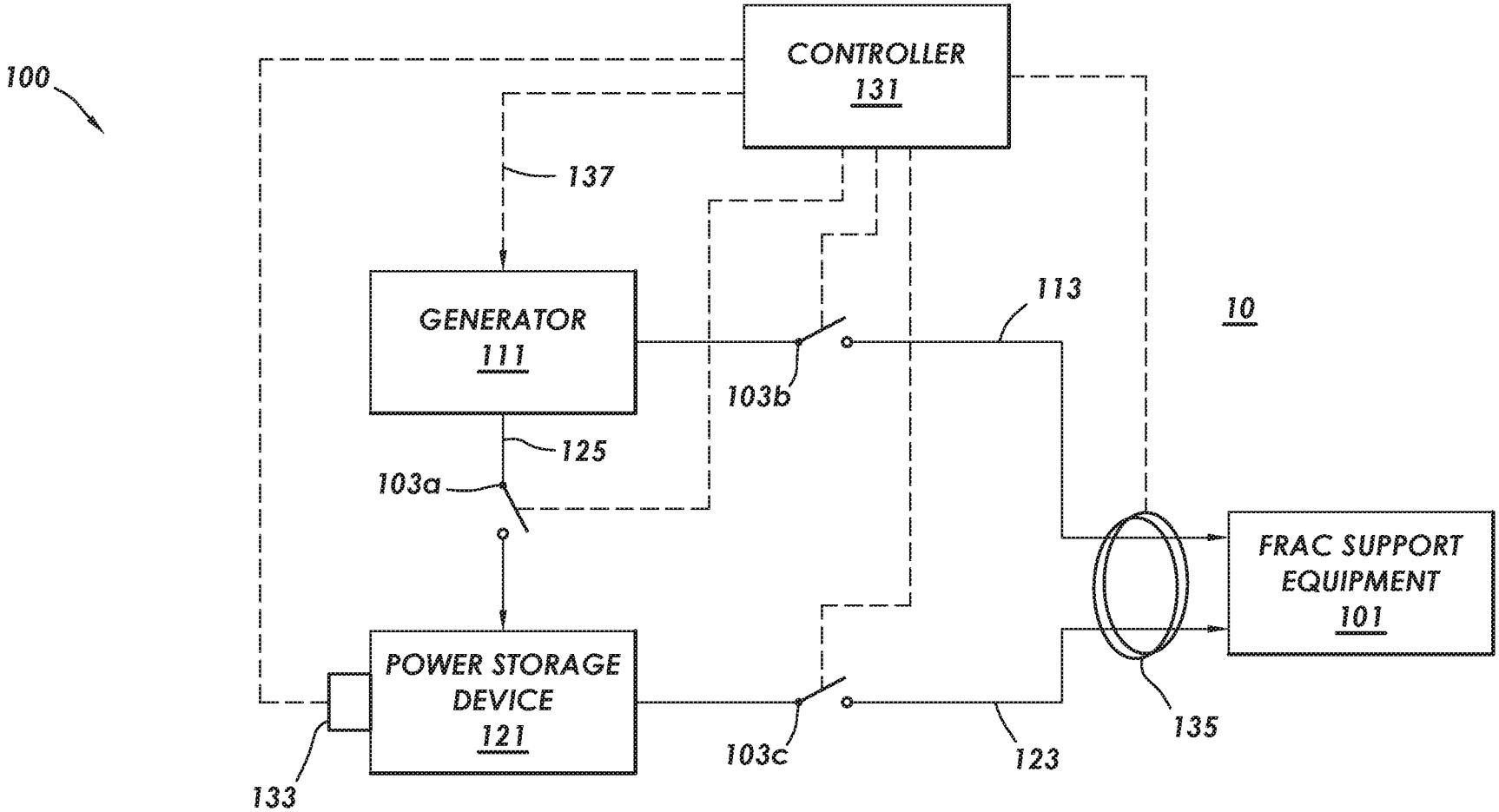
FIG. 1 depicts a block diagram of a frac system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a block diagram of frac system 100 consistent with at least one embodiment of the present disclosure. Frac system 100 may be positioned at wellsite 10. In some embodiments, frac system 100 may include frac equipment 101. Frac equipment 101 may include, for example and without limitation, one or more blenders, hydrators, CAS, belt loaders, acidizing units, chemical additive units, frac pumps, light plants, and control systems such as a data van. One or more elements of frac equipment 101 may be powered by electricity.

In some embodiments, frac system 100 includes generator 111. Generator 111 may be positioned on-site at wellsite 10. In some embodiments, generator 111 may be a diesel generator. In some embodiments, generator 111 may be a natural-gas powered generator. In some embodiments, frac system 100 may include two or more generators 111.

In some embodiments, frac system 100 may include power storage device 121. Power storage device 121 may be used to store electric power, such as power generated by generators 111. In some embodiments, power storage device 121 may include, for example and without limitation, one or more batteries, capacitors, electromechanical power storage devices, or other power storage devices known in the art. In certain embodiments, power storage device 121 may be omitted.

As depicted schematically in FIG. 1, frac equipment 101 may be electrically coupled to generator 111 by one or more power lines, depicted as generator supply line 113, and may be electrically coupled to power storage device 121 by one or more power lines, depicted as storage supply line 123. Power storage device 121 may be electrically coupled to generator 111 by one or more power lines, depicted as charge line 125. Electrical coupling between elements of frac system 100 may be accomplished by power distribution equipment as described below. Power distribution equipment includes, but is not limited to, switchgear, transformers, breakers, and relays.

In some embodiments, frac system 100 may include power controller 131. Power controller 131 may, in some embodiments, control the operation of the power supply of frac system 100. In some embodiments, for example and without limitation, power controller 131 may control the electrical connections provided by generator supply line 113, storage supply line 123, and charge line 125 as further discussed herein below. Control over these connections may be accomplished by a power distribution system indicated by switches 103*a-c*. In some embodiments, power controller 131 may include a processor adapted to perform computer program instructions stored on tangible, non-transitory computer memory media. In some embodiments, the processor may be, for example and without limitation, a microprocessor, microcontroller, digital signal processor, ASIC, FPGA, or CPLD.

In some embodiments, power controller 131 may include one or more sensors used to measure one or more states of components of frac system 100. For example, in some embodiments, power controller 131 may include charge sensor 133 used to determine the charge state of power storage device 121. In some embodiments, power controller 131 may include load sensor 135 used to determine the electrical power load being used by frac equipment 101.

In some embodiments, power controller 131 may be adapted to control the operation of generator 111. In such embodiments, power controller 131, through control line 137 as shown schematically in FIG. 1, may control operation of generator 111 by one or more of selectively turning on generator 111, turning off generator 111, or controlling the power output of generator 111.

In some embodiments, power controller 131 may use information determined from charge sensor 133 and load sensor 135 to select an operational state for frac system 100. In such an embodiment, power controller 131 may select among states, including, but not limited to, states in which frac equipment 101 is powered by generator 111 alone, by power storage device 121 alone, or by a combination of generator 111 and power storage device 121. Power controller 131 may, in a state when a combination of generator 111 and power storage device 121 are both operating, determine the power from generator 111 and the power from power storage device 121. In some embodiments, power controller 131 may further determine whether generator 111 is to be enabled. In some embodiments, power controller 131 may determine whether power storage device 121 is to be charged during operation of generator 111. In certain embodiments, a gas turbine, such as described below with respect to FIG. 10 may be used in place of generator 111.

Figure 2:
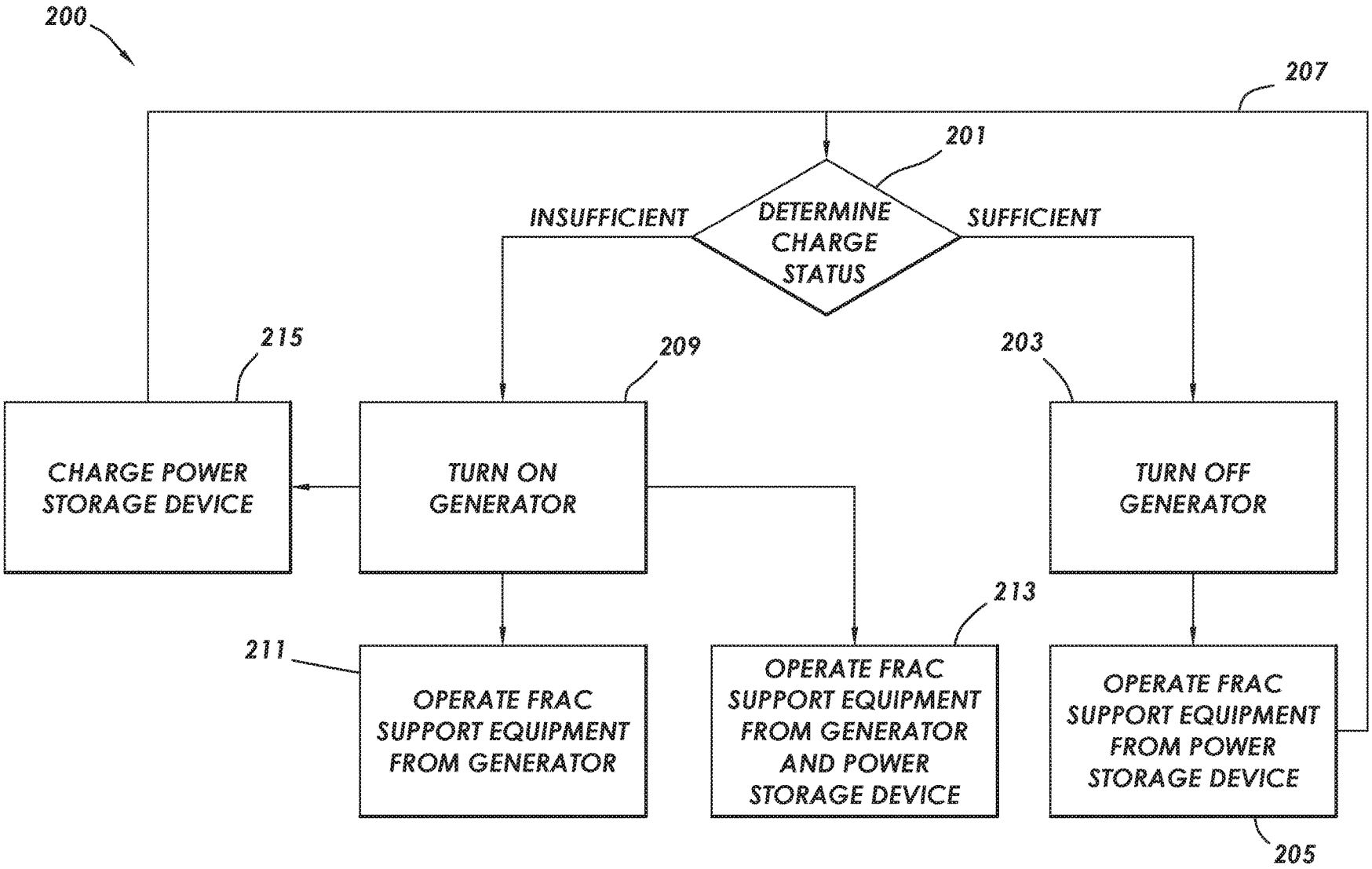
FIG. 2 depicts a process flow diagram of a frac system consistent with at least one embodiment of the present disclosure.

FIG. 2 depicts a nonlimiting example of a process flow diagram for the operation [200] of frac system 100 consistent with at least one embodiment of the present disclosure. In some embodiments, power controller 131 may initially determine the charge status [201] of power storage device 121 using charge sensor 133. Where power storage device 121 is sufficiently charged to allow for a desired period of operation of frac equipment 101 without need for operation of generator 111 as determined by load sensor 135 or by one or more user inputs, power controller 131 may turn off generator 111 if generator 111 is in operation [203], and may selectively electrically connect power storage device 121 to frac equipment 101 such that frac equipment 101 is operated on power from power storage device 121 [205]. In such an embodiment, generator 111 is off, reducing wear, fuel expenditure, noise, and emissions as compared to a system in which generator 111 is otherwise in continuous operation.

In some cases, while operating using power from power storage device 121 alone, power controller 131 may continue to monitor the charge state of power storage device 121 using charge sensor 133 [207]. If power controller 131 determines that the charge state of power storage device 121 falls below a threshold charge state, power controller 131 may turn on generator 111 [209]. In some embodiments, power from generator 111 may be used to provide power to frac equipment 101 [211]. In some embodiments, power from generator 111 may be used to charge power storage device 121. In some embodiments, power controller 131 may determine whether to power frac equipment 101 from both generator 111 and power storage device 121 once generator 111 is turned on [213] depending, for example and without limitation, on the charge state of power storage device 121 as measured by charge sensor 133 and the power load of frac equipment 101 as measured by load sensor 135.

In some embodiments, power from generator 111 may be used to both power frac equipment 101 and charge power storage device 121 [215]. Such an operating state may be used when, for example and without limitation, the power load from frac equipment 101 is sufficiently below the power output of generator 111 to allow excess power to be used to charge power storage device 121 without affecting operation of frac equipment 101 or when frac equipment 101 is not in operation and it is desired to charge power storage device 121.

In other cases, where power storage device 121 is determined to not be sufficiently charged to allow for the desired period of operation of frac equipment 101 without need for operation of generator 111 as determined by load sensor 135 or by one or more user inputs [201], power controller 131 may turn on generator 111 [209] if generator 111 is not on and may determine whether to power frac support equipment 201 from generator 111 alone [211] or from generator 111 and power storage device 121 [213] as well as whether to charge power storage device 121 [215].

Figure 3:
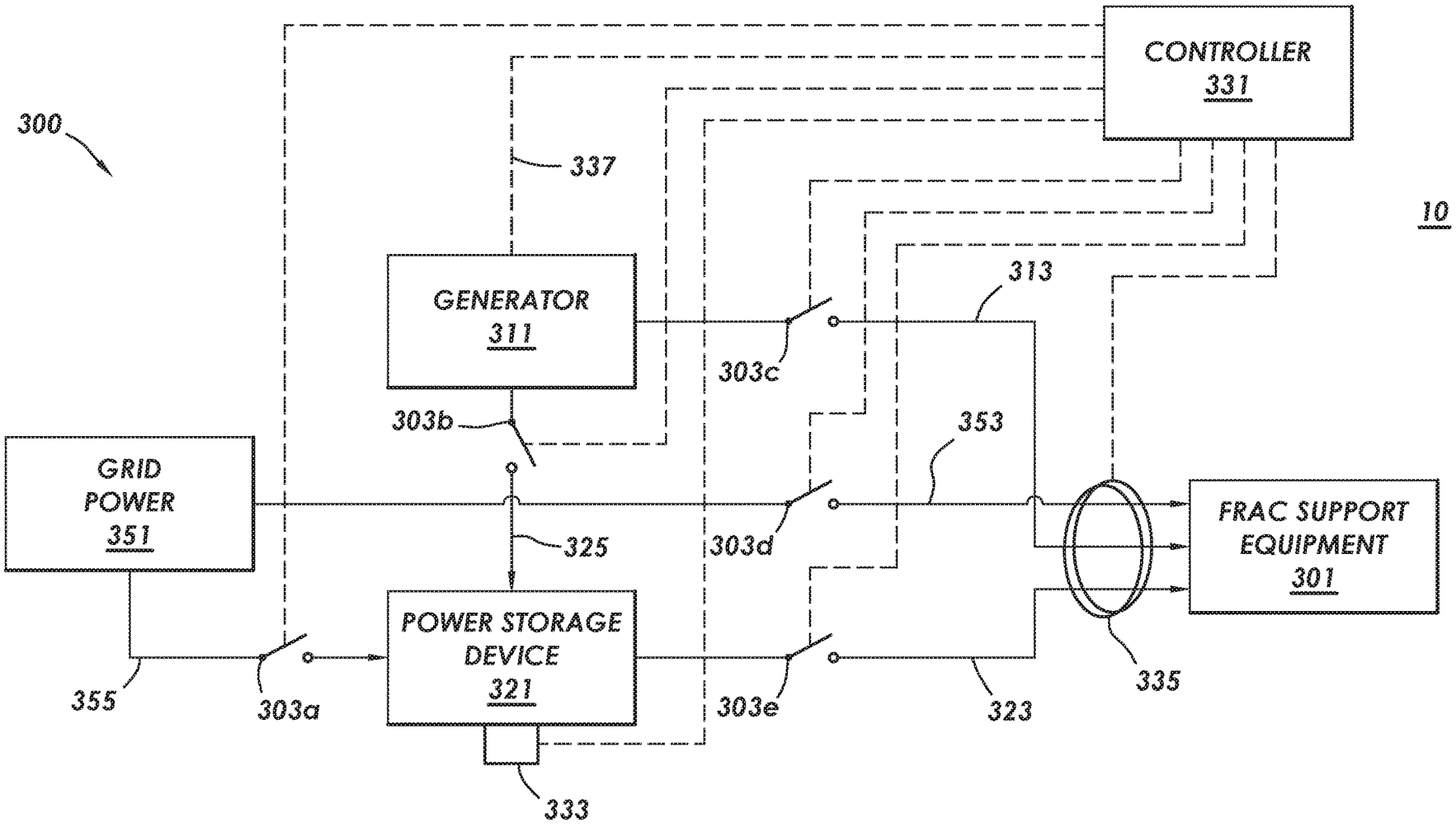
FIG. 3 depicts a block diagram of a frac system consistent with at least one embodiment of the present disclosure.

In some embodiments such as discussed with respect to FIG. 1, power supplied to frac system 100 may be limited to only that provided by generator 111. In other embodiments as depicted schematically in FIG. 3, power from a utility depicted as grid power 351 may be available at least part of the time to frac system 300. FIG. 3 depicts a block diagram of frac system 300 consistent with at least one embodiment of the present disclosure. Frac system 300 may be positioned at wellsite 10. In some embodiments, frac system 300 may include frac equipment 301. One or more elements of frac equipment 301 may be powered by electricity.

In some embodiments, frac system 300 includes generator 311. Generator 311 may be positioned on-site at wellsite 10. In some embodiments, generator 311 may be a diesel generator. In some embodiments, generator 311 may be a natural-gas powered generator. In some embodiments, frac system 300 may include two or more generators 311.

In some embodiments, frac system 300 may include power storage device 321. Power storage device 321 may be used to store electric power, such as power generated by generators 311. In some embodiments, power storage device 321 may include, for example and without limitation, one or more batteries, capacitors, electromechanical power storage devices, or other power storage devices known in the art. In certain embodiments, power storage device 321 may be omitted.

As depicted schematically in FIG. 3, frac equipment 301 may be electrically coupled to generator 311 by one or more power lines, depicted as generator supply line 313, and may be electrically coupled to power storage device 321 by one or more power lines, depicted as storage supply line 323. Power storage device 321 may be electrically coupled to generator 311 by one or more power lines, depicted as charge line 325.

In some embodiments, frac system 300 may include power controller 331. Power controller 331 may, in some embodiments, control the operation of the power supply of frac system 300. In some embodiments, for example and without limitation, power controller 331 may control the electrical connections provided by generator supply line 313, storage supply line 323, and charge line 325 as further discussed herein below. Control over these connections may be accomplished by a power distribution system indicated by switches 303*a-e*.

In some embodiments, power controller 331 may include one or more sensors used to measure one or more states of components of frac system 300. For example, in some embodiments, power controller 331 may include charge sensor 333 used to determine the charge state of power storage device 321. In some embodiments, power controller 331 may include load sensor 335 used to determine the electrical power load being used by frac equipment 301.

In some embodiments, power controller 331 may be adapted to control the operation of generator 311. In such embodiments, power controller 331, through control line 337 as shown schematically in FIG. 3, may control operation of generator 311 by one or more of selectively turning on generator 311, turning off generator 311, or controlling the power output of generator 311.

In some embodiments, grid power 351 may be available to frac system 300 and may be used to power frac equipment 301 and/or charge power storage device 321. In some cases, availability of grid power 351 may be dependent on several factors including, for example and without limitation, whether the utility company providing grid power 351 allows the power draw required by frac system 300 and whether grid power 351 is cost effective compared to power from generator 311. In some embodiments, grid power 351 may be electrically coupled to frac equipment 301 by one or more power lines, depicted as grid supply line 353, and may be electrically coupled to power storage device 321 by one or more power lines, depicted as grid charge line 355.

In some embodiments, power controller 331 may use information determined from charge sensor 333 and load sensor 335 to select an operational state for frac system 300. In such an embodiment, power controller 331 may select among states in which frac equipment 301 is powered by generator 311 alone, by power storage device 321 alone, by grid power 351 alone, or by a combination of one or more of generator 311, power storage device 321, and grid power 351. In some embodiments, power controller 331 may further determine whether generator 311 is to be enabled. In some embodiments, power controller 331 may determine whether power storage device 321 is to be charged during operation of generator 311 or while grid power 351 is available. In some embodiments, power controller 311 may determine to charge power storage device 321 from generator 311 or grid power 351.

Figure 4:
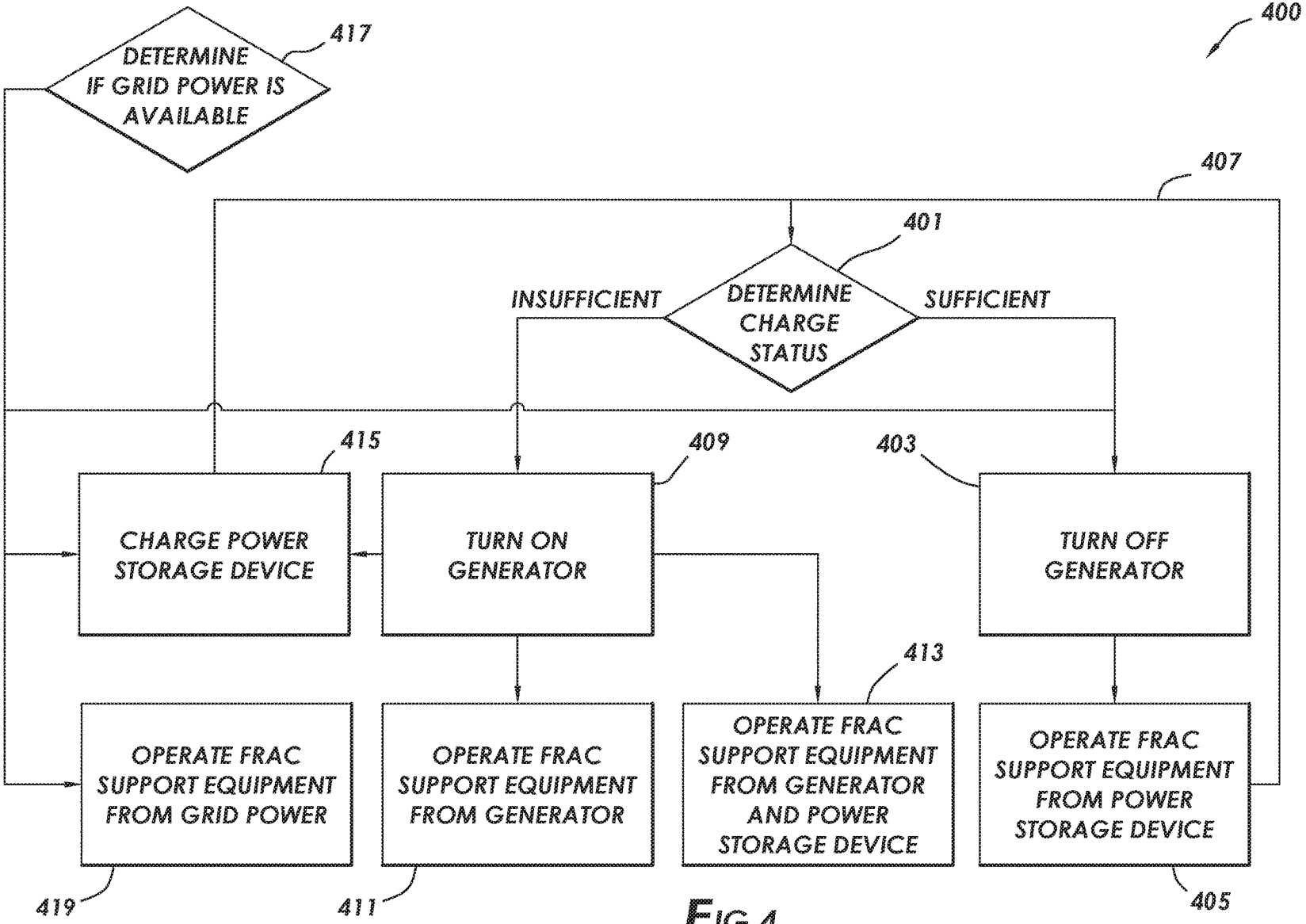
FIG. 4 depicts a process flow diagram of a frac system consistent with at least one embodiment of the present disclosure.

FIG. 4 depicts a nonlimiting example of a process flow diagram for the operation [400] of frac system 300 consistent with at least one embodiment of the present disclosure. In some embodiments, power controller 331 may initially determine the charge status [401] of power storage device 321 using charge sensor 333. Where power storage device 321 is sufficiently charged to allow for a desired period of operation of frac equipment 301 without need for operation of generator 311 as determined by load sensor 335 or by one or more user inputs, power controller 331 may turn off generator 311 if generator 311 is in operation [403], and may selectively electrically connect power storage device 321 to frac equipment 301 such that frac equipment 301 is operated on power from power storage device 321 [405]. In such an embodiment, generator 311 is off, reducing wear, fuel expenditure, noise, and emissions as compared to a system in which generator 311 is otherwise in continuous operation.

In some cases, while operating using power from power storage device 321 alone, power controller 331 may continue to monitor the charge state of power storage device 321 using charge sensor 333 [407]. If power controller 331 determines that the charge state of power storage device 321 falls below a threshold charge state, power controller 331 may turn on generator 311 [409]. In some embodiments, power from generator 311 may be used to provide power to frac equipment 301 [411]. In some embodiments, power from generator 311 may be used to charge power storage device 321. In some embodiments, power controller 331 may determine whether to power frac equipment 301 from both generator 311 and power storage device 321 once generator 311 is turned on [413] depending, for example and without limitation, on the charge state of power storage device 321 as measured by charge sensor 333 and the power load of frac equipment 301 as measured by load sensor 335.

In some embodiments, power from generator 311 may be used to both power frac equipment 301 and charge power storage device 321 [415]. Such an operating state may be used when, for example and without limitation, the power load from frac equipment 301 is sufficiently below the power output of generator 311 to allow excess power to be used to charge power storage device 321 without affecting operation of frac equipment 301 or when frac equipment 301 is not in operation and it is desired to charge power storage device 321.

In other cases, where power storage device 321 is determined to not be sufficiently charged to allow for the desired period of operation of frac equipment 301 without need for operation of generator 311 as determined by load sensor 335 or by one or more user inputs [401], power controller 331 may turn on generator 311 [409] if generator 311 is not on and may determine whether to power frac support equipment 101 from generator 311 alone [411] or from generator 311 and power storage device 321 [413] as well as whether to charge power storage device 321 [415].

In some cases where it is determined that grid power is available to be used by frac system 300 [417], power controller 331 may determine whether to charge power storage device 321 [415] and/or operate frac equipment 301 from grid power [419]. Power controller 331 may also determine whether to turn off generator 311 [403] when grid power is available.

Figure 5:
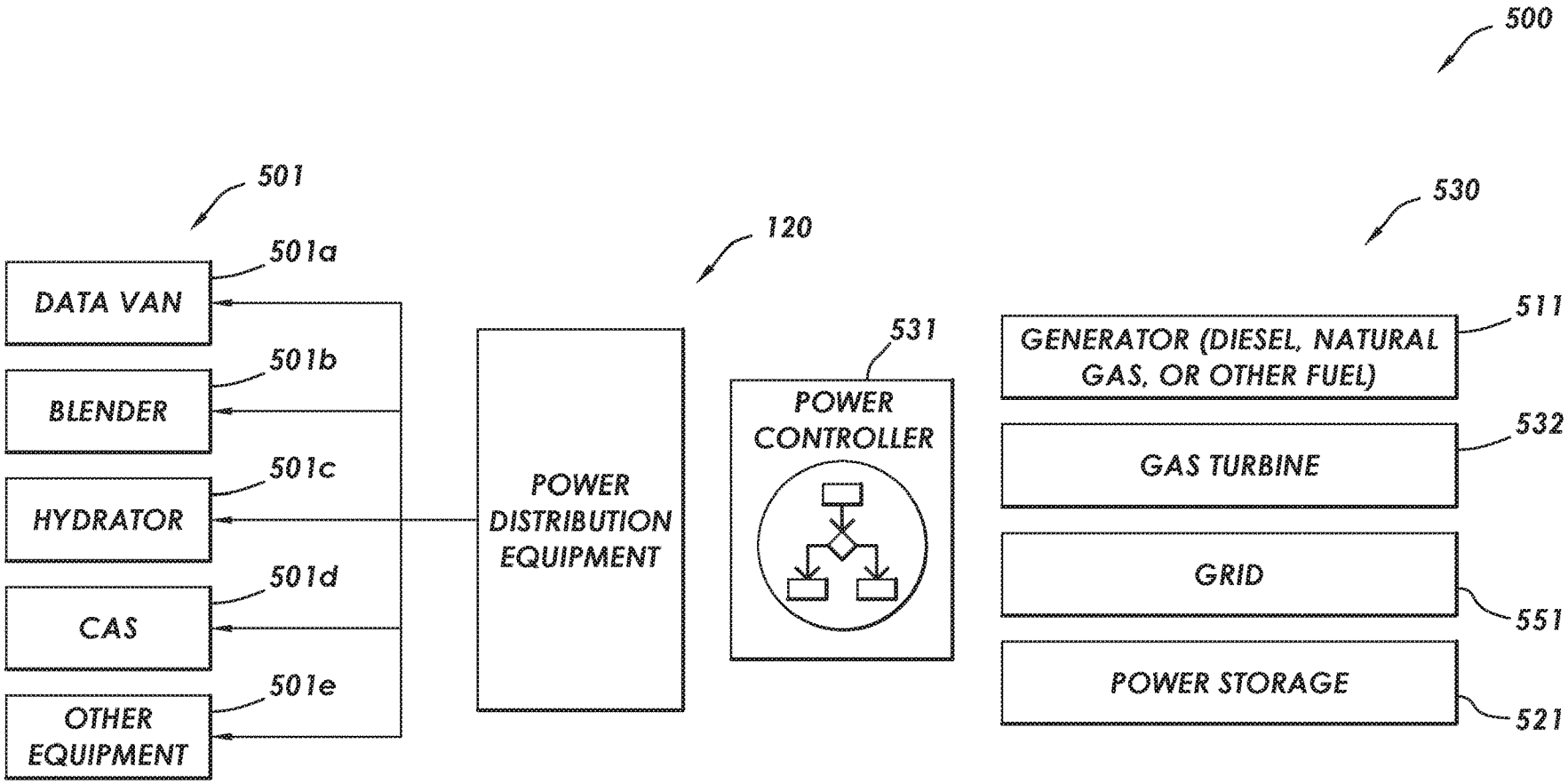
FIG. 5 depicts a block diagram of a frac system consistent with at least one embodiment of the present disclosure.

FIGS. 5-11 depict additional embodiments of frac systems consistent with embodiments of the present disclosure. FIG. 5 is an overview block diagram of frac system 500 of an exemplary embodiment. FIG. 5 includes frac equipment 501. In a non-limiting embodiment, frac equipment may include data van 501*a*, blender 501*b*, hydrator 501*c*, CAS 501*d*, and other equipment 501*e*, which can include, but is not limited to belt loaders, acidizing units, chemical additive units, frac pumps, and light plants. Frac system 500 may also include power distribution equipment 120 in electrical communication with frac equipment 501. Frac system 500 further includes power controller 531. In addition, frac system 500 includes power generation equipment 530. Power generation equipment 530 may include, for example, generator 511, gas turbine 532, grid power 551, power storage device 521, and combinations thereof. Generators 511 may be diesel, natural gas, or may use other types of fuel.

Figure 6:
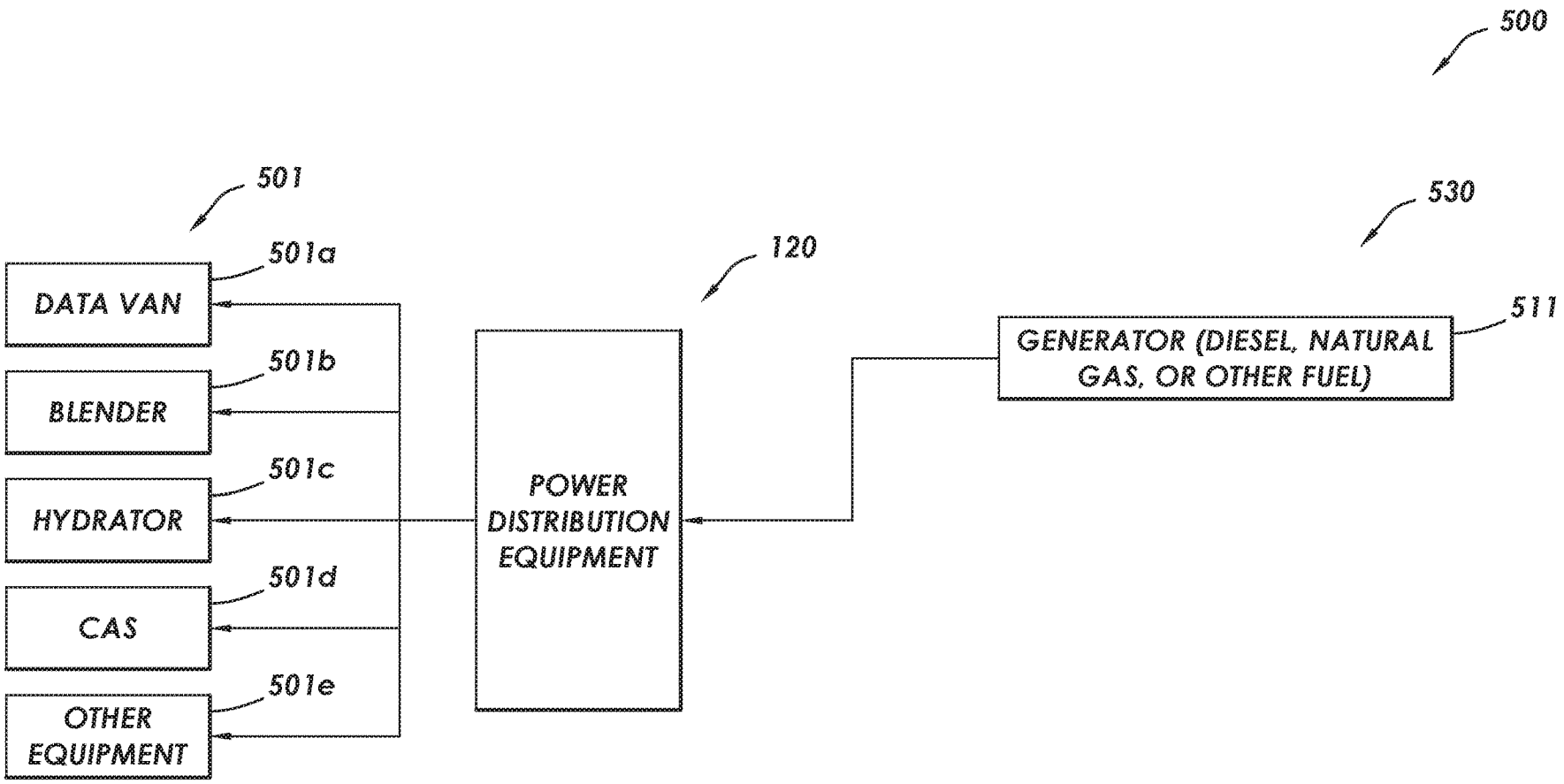
FIG. 6 depicts a block diagram of a frac system consistent with at least one embodiment of the present disclosure.

In the embodiment shown in FIG. 6, generator 511 is in electrical connection with power distribution equipment 120, which is in electrical connection with frac equipment 501. In the embodiment shown in FIG. 6, power controller 531 is omitted.

Figure 7:
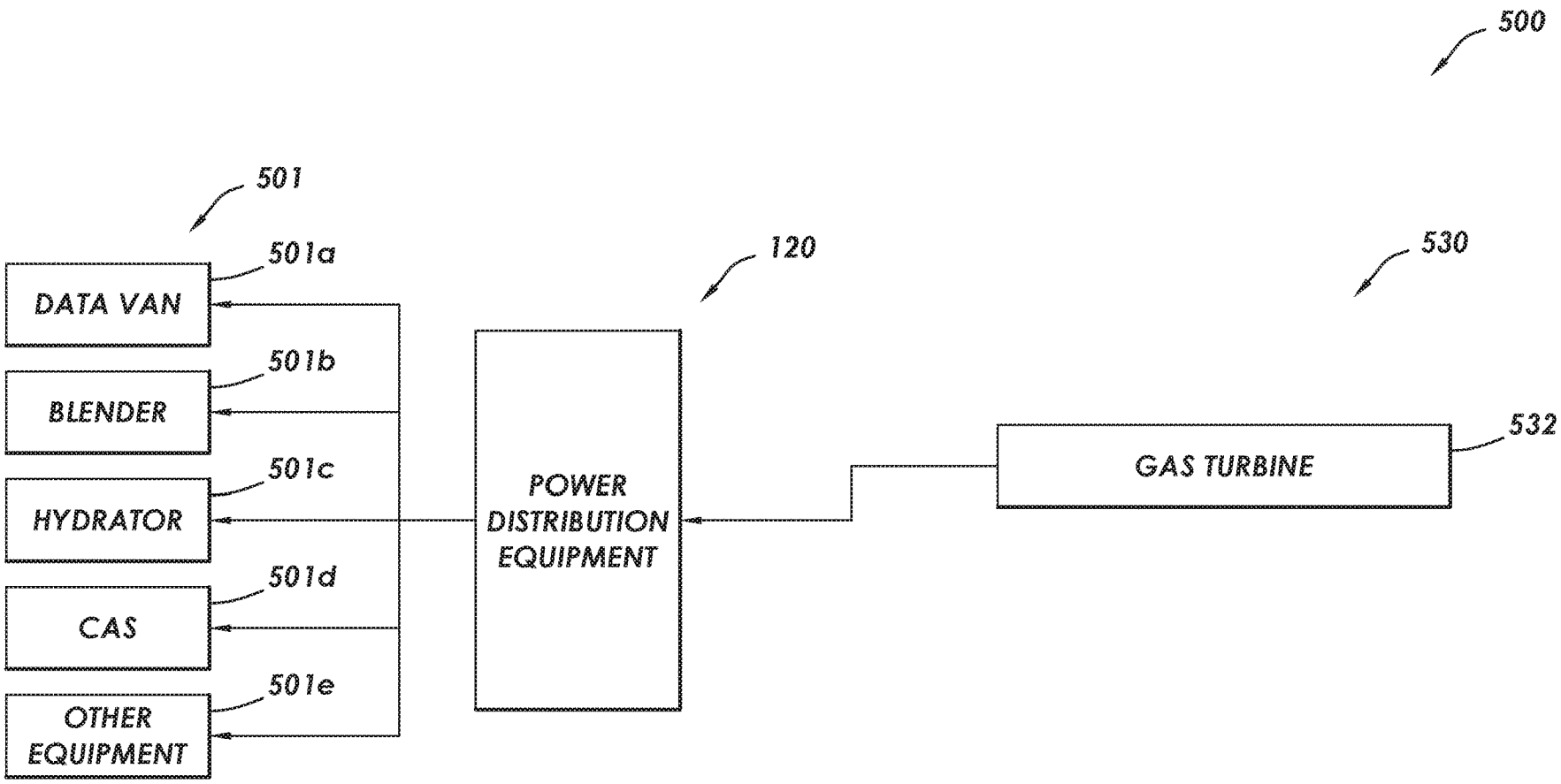
FIG. 7 depicts a block diagram of a frac system consistent with at least one embodiment of the present disclosure.

In the embodiment shown in FIG. 7, gas turbine 532 is in electrical connection with power distribution equipment 120, which is in electrical connection with frac equipment 501. In the embodiment shown in FIG. 7, power controller 531 is omitted.

Figure 8:
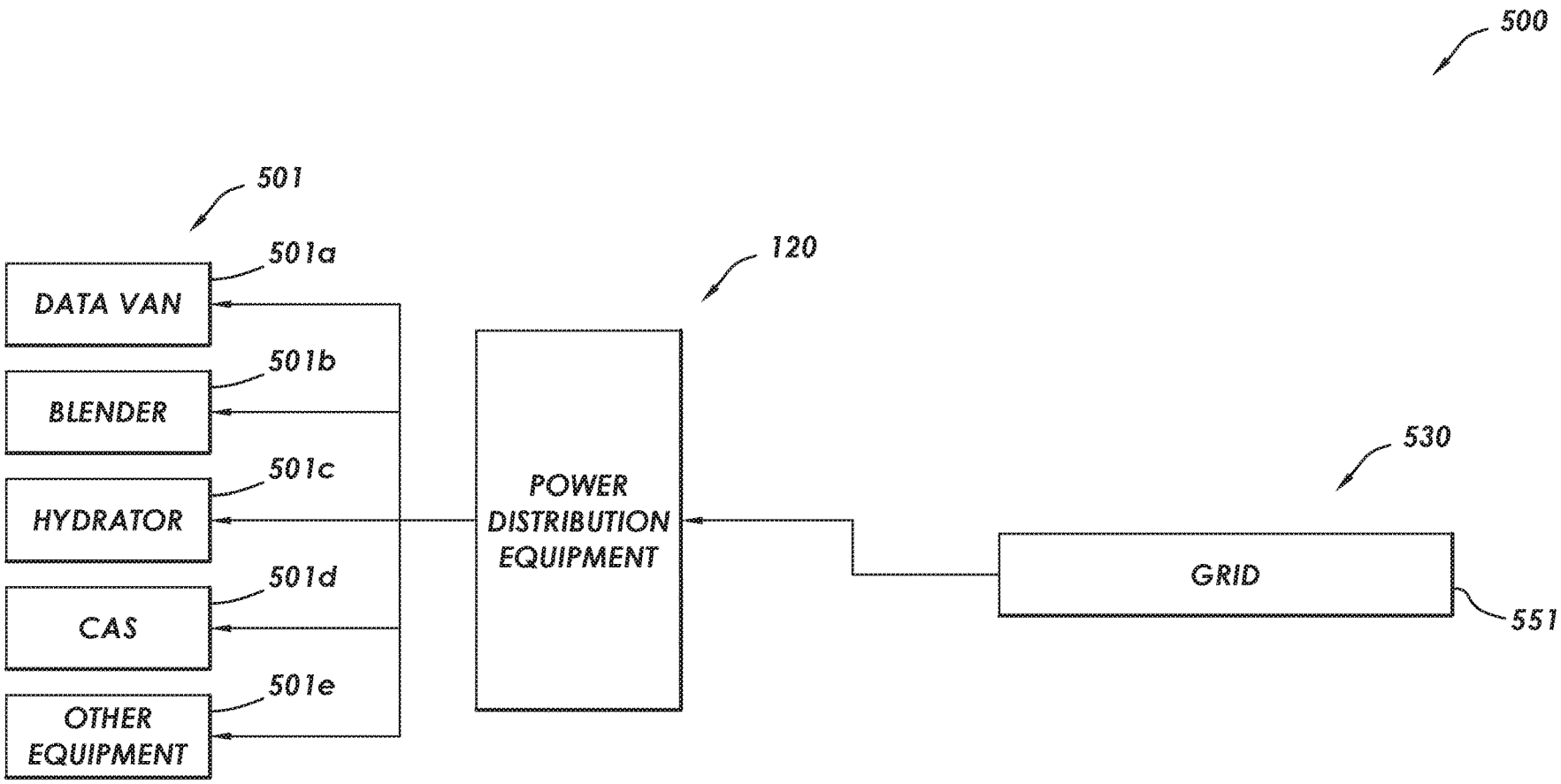
FIG. 8 depicts a block diagram of a frac system consistent with at least one embodiment of the present disclosure.

In the embodiment shown in FIG. 8, grid power 551 is in electrical connection with power distribution equipment 120, which is in electrical connection with frac equipment 501. In the embodiment shown in FIG. 8, power controller 531 is omitted.

Figure 9:
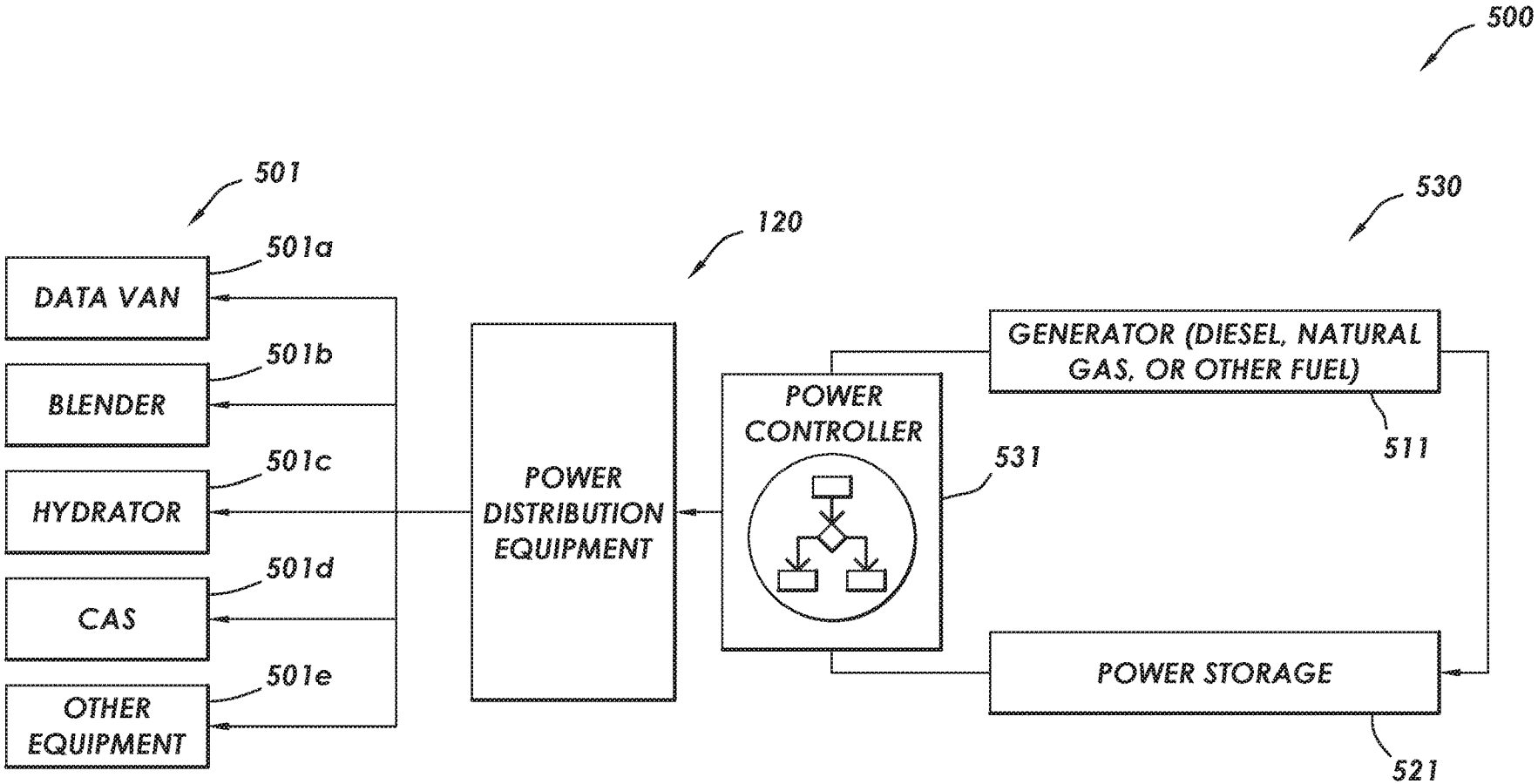
FIG. 9 depicts a block diagram of a frac system consistent with at least one embodiment of the present disclosure.

In the embodiment shown in FIG. 9, generator 511 and power storage device 521 are in electrical connection. Generator 511 and power storage device 521 are in data connection with power controller 531 and in electrical connection with power distribution equipment 120. Power distribution equipment 120 is in electrical connection with frac equipment 501. Power controller 531 operates as described above with respect to power controller 131.

Figure 10:
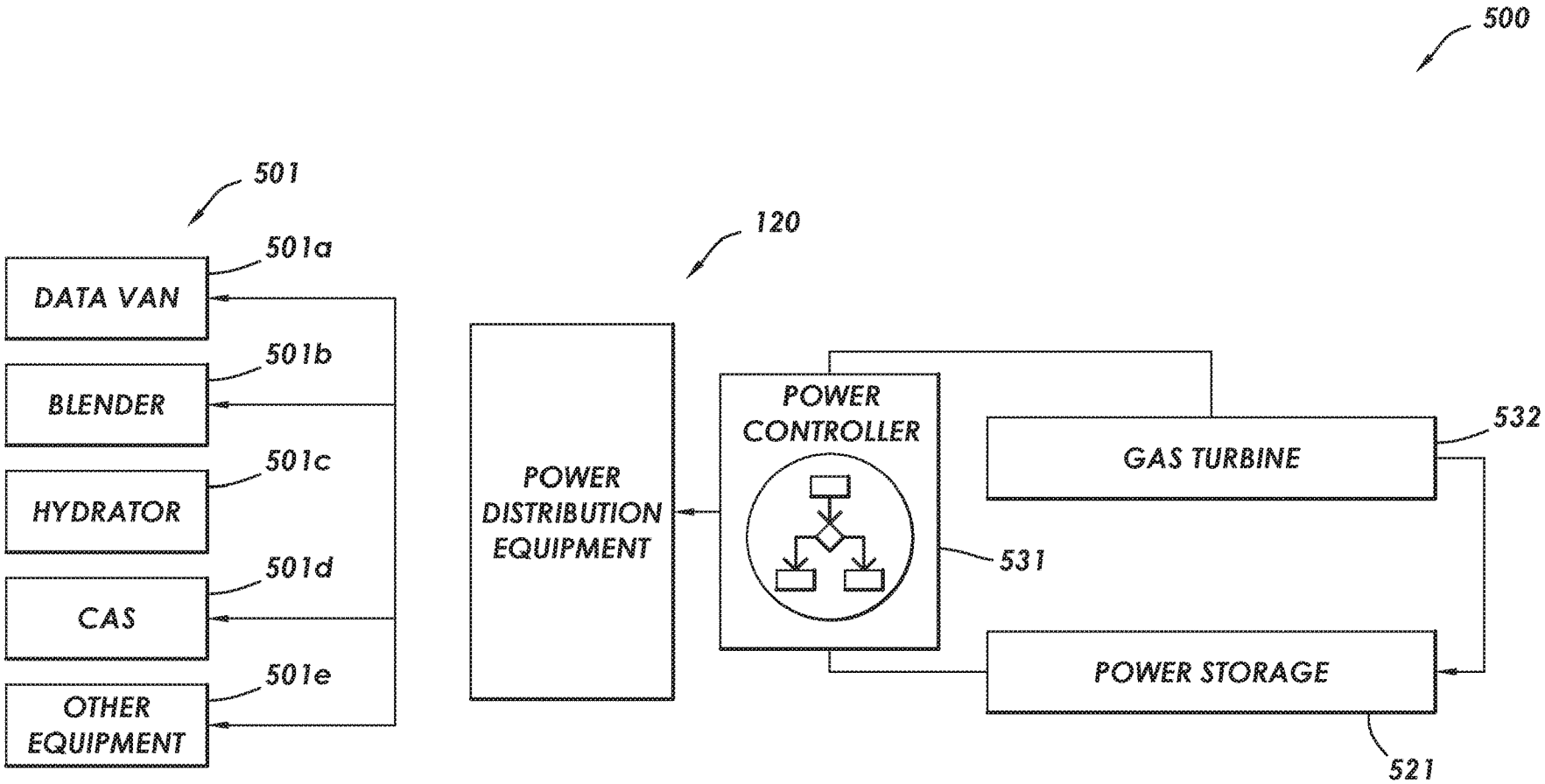
FIG. 10 depicts a block diagram of a frac system consistent with at least one embodiment of the present disclosure.

In the embodiment shown in FIG. 10, gas turbine 532 and power storage device 521 are in electrical connection. Gas turbine 532 and power storage device 521 are in data connection with power controller 531 and in electrical connection with power distribution equipment 120. Power distribution equipment 120 is in electrical connection with frac equipment 501. Power controller 531 operates as described above with respect to power controller 131.

Figure 11:
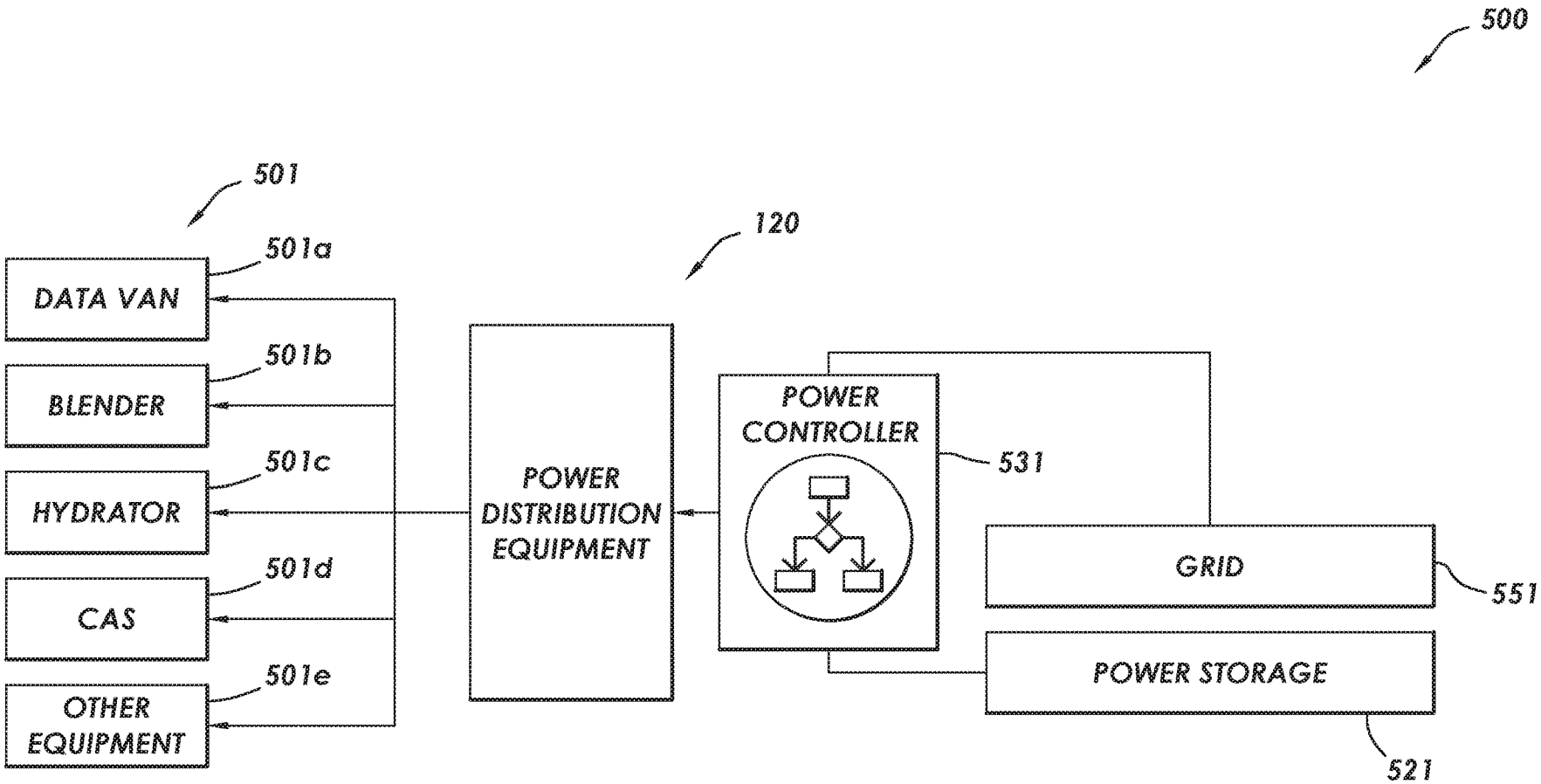
FIG. 11 depicts a block diagram of a frac system consistent with at least one embodiment of the present disclosure.

In the embodiment shown in FIG. 11, grid power 551 and power storage device 521 are in electrical connection. Grid power 551 and power storage device 521 are in data connection with power controller 531 and in electrical connection with power distribution equipment 120. Power distribution equipment 120 is in electrical connection with frac equipment 501. Power controller 531 operates as described above with respect to power controller 131.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

providing a frac system including:

one or more pieces of frac equipment including at least one electric frac pump;

power generation equipment, the power generation equipment including a generator or a gas turbine;

power distribution equipment in electrical communication with the frac equipment and with the power generation equipment, wherein the power distribution equipment includes at least one component selected from the group consisting of switchgear, breakers, and relays;

a power storage device; and a power controller, the power controller including a charge sensor adapted to determine the charge state of the power storage device and a load sensor, the load sensor adapted to determine an electrical power load being used by the frac equipment;

measuring, with the power controller, the charge status for the power storage device;

measuring, with the power controller, the electrical power load being used by the frac equipment;

determining, with the power controller, that grid power is available;

if the charge status for the power storage device is sufficient to power the frac equipment as determined from the load sensor, powering the frac equipment from the power storage device alone;

if the charge status for the power storage device is not sufficient to power the frac equipment alone, using the grid power and the power storage device; grid power and the generator; grid power and the gas turbine; grid power, the power storage device and the generator; the gas turbine and the generator; or grid power, the generator, the gas turbine, and the power storage device to power the frac equipment; and engaging or disengaging the power generation equipment based on the measured charge status and electrical power load.

2. The method of claim 1, wherein the frac equipment comprises one or more blenders, hydrators, CAS, belt loaders, acidizing units, chemical additive units, frac pumps, light plants, and control systems.

3. The method of claim 1, wherein the generator is a diesel generator or a natural-gas powered generator.

4. The method of claim 1, wherein the frac equipment further comprises one or more blenders, hydrators, CAS, belt loaders, acidizing units, chemical additive units, frac pumps, light plants, or control systems.

5. The method of claim 1 wherein the power controller comprises a processor selected from the group consisting of microprocessors, microcontrollers, digital signal processors, application-specific integrated circuits, field programmable gate arrays, or complex programmable logic devices.

6. The method of claim 1, wherein the if the charge status for the power storage device is not sufficient to power the frac equipment alone, using the controller to direct the grid power; grid power and the generator; grid power and the gas turbine; grid power, and the generator; the gas turbine and the generator; or grid power, the generator, and the gas turbine to charge the power storage device while powering the frac equipment.

7. The method of claim 6, wherein the power storage device powers the frac equipment.

8. The method of claim 6, wherein the power storage devices does not power the frac equipment.

* * * * *